US009688510B2

(12) United States Patent
Strbuncelj

(10) Patent No.: US 9,688,510 B2
(45) Date of Patent: Jun. 27, 2017

(54) HYDRAULIC BRAKE SYSTEM FOR ELEVATOR

(75) Inventor: Zlatko Strbuncelj, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 208 days.

(21) Appl. No.: 14/418,329

(22) PCT Filed: Aug. 2, 2012

(86) PCT No.: PCT/US2012/049302

§ 371 (c)(1),
(2), (4) Date: Jan. 29, 2015

(87) PCT Pub. No.: WO2014/021896

PCT Pub. Date: Feb. 6, 2014

(65) Prior Publication Data

US 2015/0191328 A1 Jul. 9, 2015

(51) Int. Cl.

| | |
|---|---|
| ***B66B 5/02*** | (2006.01) |
| ***B66D 5/14*** | (2006.01) |
| ***B66D 5/26*** | (2006.01) |
| ***B66B 1/36*** | (2006.01) |

(52) U.S. Cl.

CPC ..... *B66B 5/02* (2013.01); *B66B 1/365* (2013.01); *B66B 5/028* (2013.01); *B66D 5/14* (2013.01); *B66D 5/26* (2013.01)

(58) Field of Classification Search

CPC ..... B66B 5/02; B66B 5/028; B66B 1/265; B66D 5/14; B66D 5/26

USPC ..... 187/254

See application file for complete search history.

(56) References Cited

U.S. PATENT DOCUMENTS 2,099,636 A * 11/1937 Weaver ..... B66F 7/00 187/203
2,395,345 A * 2/1946 Schreck ..... B66F 9/07572 180/13
3,276,551 A * 10/1966 Buletti ..... B60T 13/38 188/106 P (Continued)

FOREIGN PATENT DOCUMENTS

EP 0183616 A2 6/1986

OTHER PUBLICATIONS

Written Opinion of the International Searching Authority; PCT/US2012/049302; Mailed Mar. 4, 2013; 6 Pages.

(Continued)

*Primary Examiner* — Michael Riegelman
(74) *Attorney, Agent, or Firm* — Cantor Colburn LLP

(57) ABSTRACT

A braking system for an elevator includes a brake disc and one or more sets of brake calipers interactive with the brake disc. A hydraulic brake unit is operably connected to the one or more brake calipers. The hydraulic brake unit includes one or more valves to control hydraulic fluid flow during engagement of the brake calipers to the brake disc. An elevator includes a car, one or more sheaves, and a suspension member connected to the car and routed over the sheaves. A machine drives motion of the elevator car. A braking system located at the machine includes a brake disc and one or more brake calipers. A hydraulic brake unit is operably connected to the brake calipers and includes one or more valves to control hydraulic fluid flow during engagement of the brake calipers to the brake disc.

12 Claims, 9 Drawing Sheets

(56) References Cited

U.S. PATENT DOCUMENTS

| | | | | |
|---|---|---|---|---|
| 3,842,943 | A * | 10/1974 | Nakamura | B66B 1/405 187/275 |
| 4,337,926 | A * | 7/1982 | Dehaan | B66D 1/44 188/105 |
| 5,265,701 | A | 11/1993 | Ogasawara et al. | |
| 5,648,644 | A * | 7/1997 | Nagel | B66B 5/18 187/288 |
| 6,193,026 | B1 * | 2/2001 | Sevilleja | B60T 13/22 187/288 |
| 2004/0251088 | A1 | 12/2004 | Ferrand et al. | |
| 2011/0014048 | A1 | 1/2011 | Roed et al. | |
| 2011/0203877 | A1 | 8/2011 | Tiner et al. | |
| 2013/0112506 | A1 * | 5/2013 | Zuercher | B66B 9/04 187/200 |

OTHER PUBLICATIONS

International Search Report; PCT/US2012/049302; Mailed Mar. 4, 2013; 5 Pages.

* cited by examiner

HYDRAULIC BRAKE SYSTEM FOR ELEVATOR

BACKGROUND OF THE INVENTION

The subject matter disclosed herein relates to elevator systems. More specifically, the subject disclosure relates to brake systems to stop and hold elevator cars of an elevator system.

Elevator systems utilize ropes or belts operably connected to an elevator car, and routed over one or more sheaves, also known as pulleys, to propel the elevator car along a hoistway. The ropes or belts are driven by a machine, often an electric motor that rotates a drive sheave, raising or lowering the elevator car in the hoistway. The machine is often located at an upper end of the hoistway. When it is desired to stop motion of the elevator car, for example, to allow passengers to enter or exit the elevator car at a selected floor, or during an emergency, one or more electromagnetic brakes are applied, either at the machine or at the elevator car to stop and hold the elevator car.

For high rise, high speed, and/or high lift elevator systems, the typical electromagnetic brake requires a large number of calipers to adequately brake the system, resulting in increased complexity and potential failures of the braking system. Further, electromagnetic brakes calipers often noisily engage with the braking disk during operation, which is undesirable for passengers in the elevator car. Also, it is desired that the braking torque of the system be adjustable once installed to a desired braking torque to effectively stop the elevator car while preventing excessive deceleration and potential passenger injury therefrom. Finally, it is desired that braking systems be manually releasable to move the elevator car to a selected floor in the case of an emergency.

BRIEF DESCRIPTION OF THE INVENTION

According to one aspect of the invention, a braking system for an elevator includes a brake disc and one or more brake calipers interactive with the brake disc. A hydraulic brake unit is operably connected to the one or more brake calipers. The hydraulic brake unit includes one or more valves control hydraulic fluid flow during engagement of the brake calipers to the brake disc.

Alternatively in this or other aspects of the invention, the one or more valves include a pressure limiting valve to maintain hydraulic fluid pressure in the brake unit within a selected range, thereby limiting braking torque of the braking system.

Alternatively in this or other aspects of the invention, the pressure limiting valve is field adjustable.

Alternatively in this or other aspects of the invention, the braking system further includes a hand-operated pump to pressurize the hydraulic brake unit in the case of a power outage.

Alternatively in this or other aspects of the invention, the braking system further includes a hand-operated push valve to relieve hydraulic pressure in the hydraulic brake unit.

Alternatively in this or other aspects of the invention, the one or more brake calipers is two brake calipers.

Alternatively in this or other aspects of the invention, the one or more valves include one or more electromagnetic valves.

Alternatively in this or other aspects of the invention, a first electromagnetic valve is positioned and configured to control hydraulic fluid flow from a hydraulic fluid source to the one or more brake calipers.

Alternatively in this or other aspects of the invention, a second electromagnetic valve is positioned and configured to control hydraulic fluid flow from the one or more brake calipers.

Alternatively in this or other aspects of the invention, a third electromagnetic valve is positioned to direct hydraulic fluid flow from the one or more brake calipers to a hydraulic fluid source.

Alternatively in this or other aspects of the invention, the third electromagnetic valve directs hydraulic fluid flow to a flow control valve to reduce a hydraulic fluid flow rate in the brake unit, thereby reducing brake caliper to brake disc impact force and noise.

Alternatively in this or other aspects of the invention, the third electromagnetic valve directs hydraulic flow directly to the hydraulic fluid source.

According to another aspect of the invention, an elevator system includes an elevator car, one or more sheaves, and a suspension member connected to the elevator car and routed around the one or more sheaves to support the elevator car. A machine drives motion of the elevator car via the suspension member. A braking system located at the machine to stop and hold the elevator car includes a brake disc and one or more brake calipers interactive with the brake disc. A hydraulic brake unit is operably connected to the one or more brake calipers, the hydraulic brake unit including one or more valves to control hydraulic fluid flow during engagement of the brake calipers to the brake disc.

The detailed description explains the invention, together with advantages and features, by way of examples with reference to the drawings.

DETAILED DESCRIPTION OF THE INVENTION

Figure 1A:
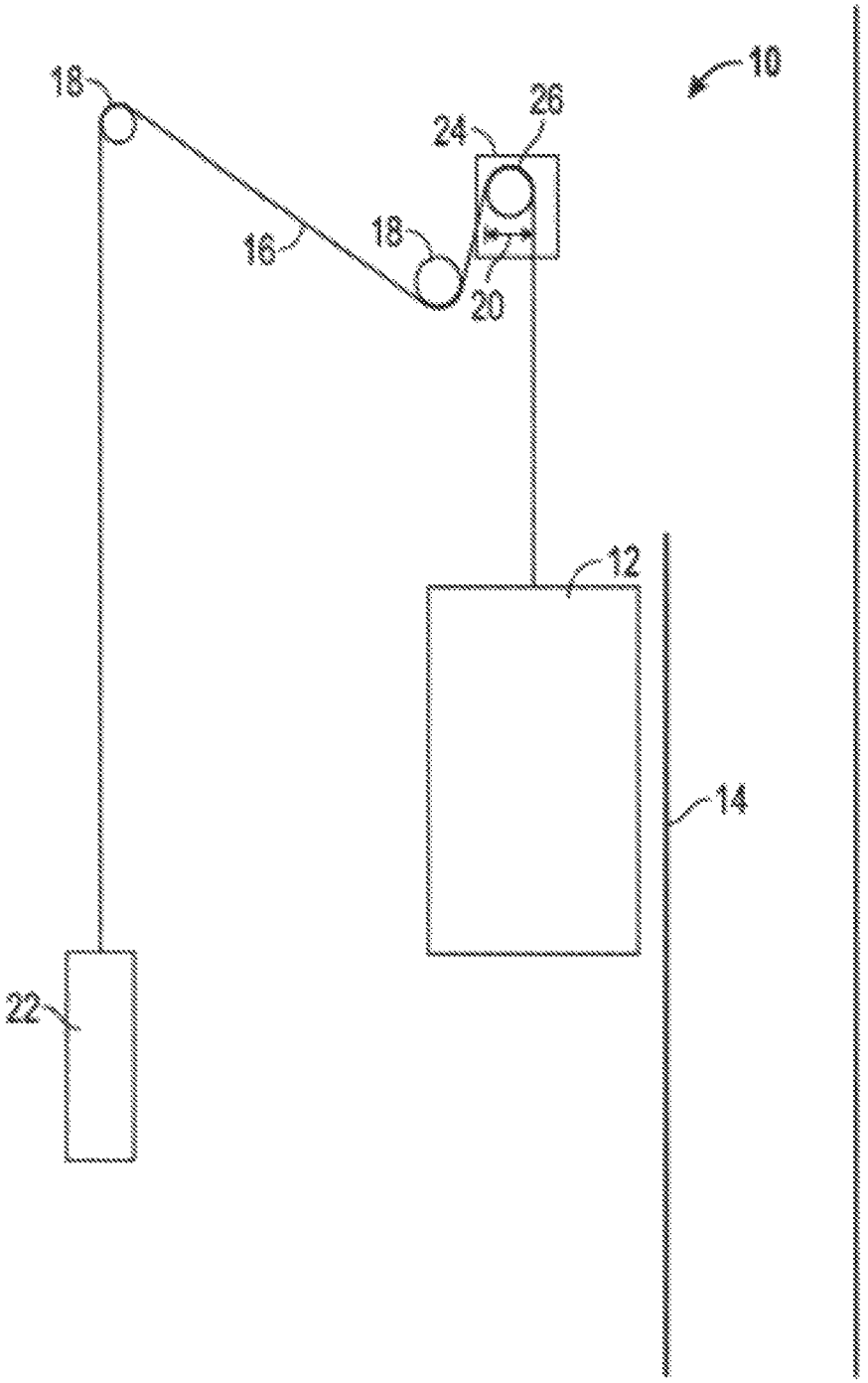
FIG. 1A PRIOR ART
FIG. 1A is a schematic of an exemplary elevator system having a 1:1 roping arrangement.
Figure 1B:
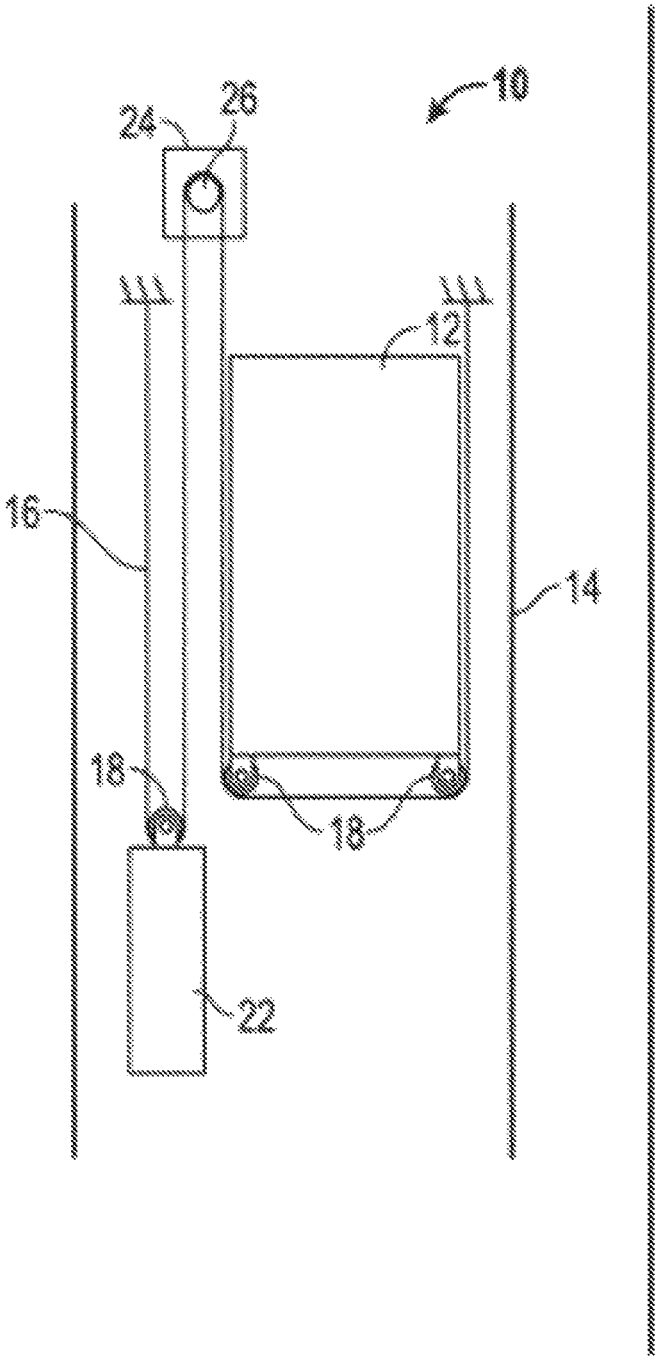
FIG. 1B PRIOR ART
FIG. 1B is a schematic of another exemplary elevator system having a 2:1 roping arrangement.
Figure 1C:
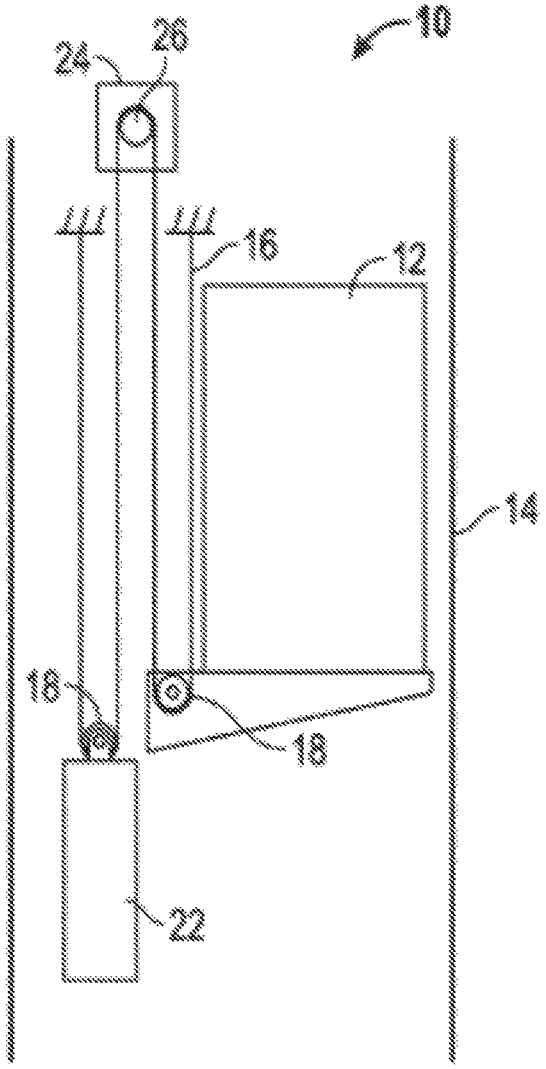
FIG. 1C PRIOR ART
FIG. 1C is a schematic of another exemplary elevator system having a cantilevered arrangement.

Shown in FIGS. 1A, 1B and 1C are schematics of exemplary traction elevator systems 10. Features of the elevator system 10 that are not required for an understanding of the present invention (such as the guide rails, safeties, etc.) are not discussed herein. The elevator system 10 includes an elevator car 12 operatively suspended in a hoistway 14 with one or suspension members 16, such as ropes or belts. The one or more suspension members 16 interact with one or more sheaves 18 to be routed around various components of the elevator system 10. The one or more suspension members 16 could also be connected to a counterweight 22, which is used to help balance the elevator system 10 during operation.

The sheaves 18 each have a diameter 20, which may be the same or different than the diameters of the other sheaves 18 in the elevator system 10. At least one of the sheaves 18 could be a traction sheave 26 and driven by a machine 24. Movement of the traction sheave 26 by the machine 24 drives (through traction) the one or more suspension members 16 that are routed around the traction sheave 26.

At least one of the sheaves 18 could be a diverter, deflector or idler sheave. Diverter, deflector or idler sheaves are not driven by a machine 24, but help guide the one or more suspension members 16 around the various components of the elevator system 10. The shape of the sheave 18 depends on the shape of the suspension member 16 that it engages.

In some embodiments, the elevator system 10 could use two or more suspension members 16 for suspending and/or driving the elevator car 12. In addition, the elevator system 10 could have various configurations such that either both sides of the one or more suspension members 16 engage the one or more sheaves 18 (such as shown in the exemplary elevator systems in FIG. 1A, 1B or 1C) or only one side of the one or more suspension members 16 engages the one or more sheaves 18.

FIG. 1A provides a 1:1 roping arrangement in which the one or more suspension members 16 terminate at the car 12 and counterweight 22. FIGS. 1B and 1C provide different roping arrangements. Specifically, FIGS. 1B and 1C show that the car 12 and/or the counterweight 22 can have one or more sheaves 18 thereon engaging the one or more suspension members 16 and the one or more suspension members 16 can terminate elsewhere, typically at a structure within the hoistway 14 (such as for a machine-room-less elevator system) or within the machine room (for elevator systems utilizing a machine room). The number of sheaves 18 used in the arrangement determines the specific roping ratio (e.g. the 2:1 roping ratio shown in FIGS. 1B and 1C or a different ratio). FIG. 1C also provides a so-called rucksack or cantilevered type elevator. The present invention could be used on elevator systems other than the exemplary types shown in FIGS. 1A, 1B and 1C.

Figure 2:
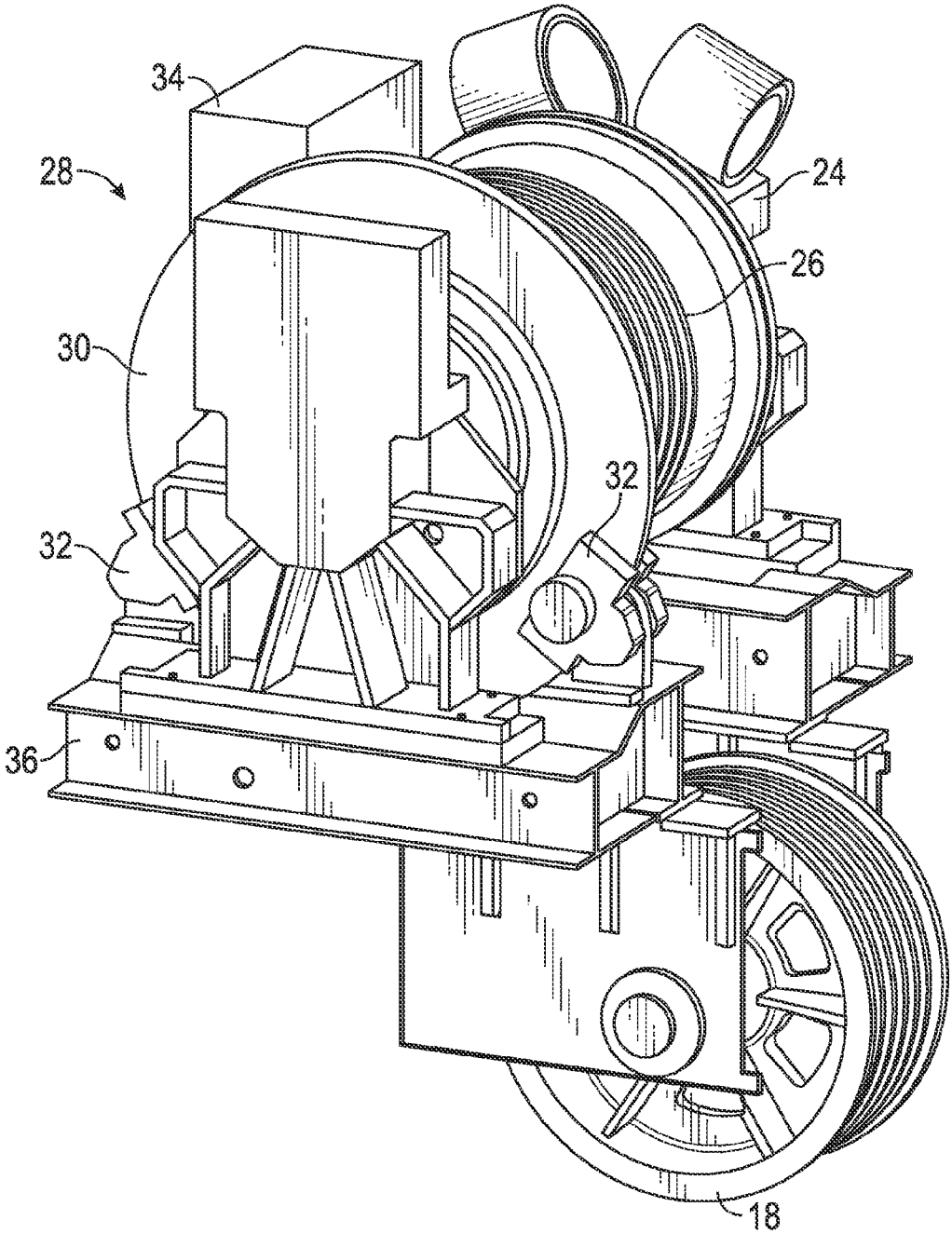
FIG. 2 is a perspective view of an embodiment of a hydraulic brake unit for an elevator system.

Referring to FIG. 2, the elevator system 10 includes a hydraulic brake unit 28. The brake unit 28 includes a brake disc 30 located at, and rotatable with the traction sheave 26, and one or more calipers 32 that, when engaged with the brake disc 30 stop and hold rotation of the traction sheave 26. The stopping of the traction sheave 26 thereby stops and holds the elevator car 12 connected to the traction sheave 26 via the one or more suspension members 16. The calipers 32 are connected to a hydraulic power unit 34 that controls actuation of the calipers 32 to engage and disengage with the brake disc 30. Although 2 of calipers 32 are shown in FIG. 2, it is to be appreciated that in other embodiments, other numbers of calipers 32 may be utilized. Further, in some embodiments, the traction sheave 26 and brake unit 28 are mounted on a bedplate 36.

Figure 3:
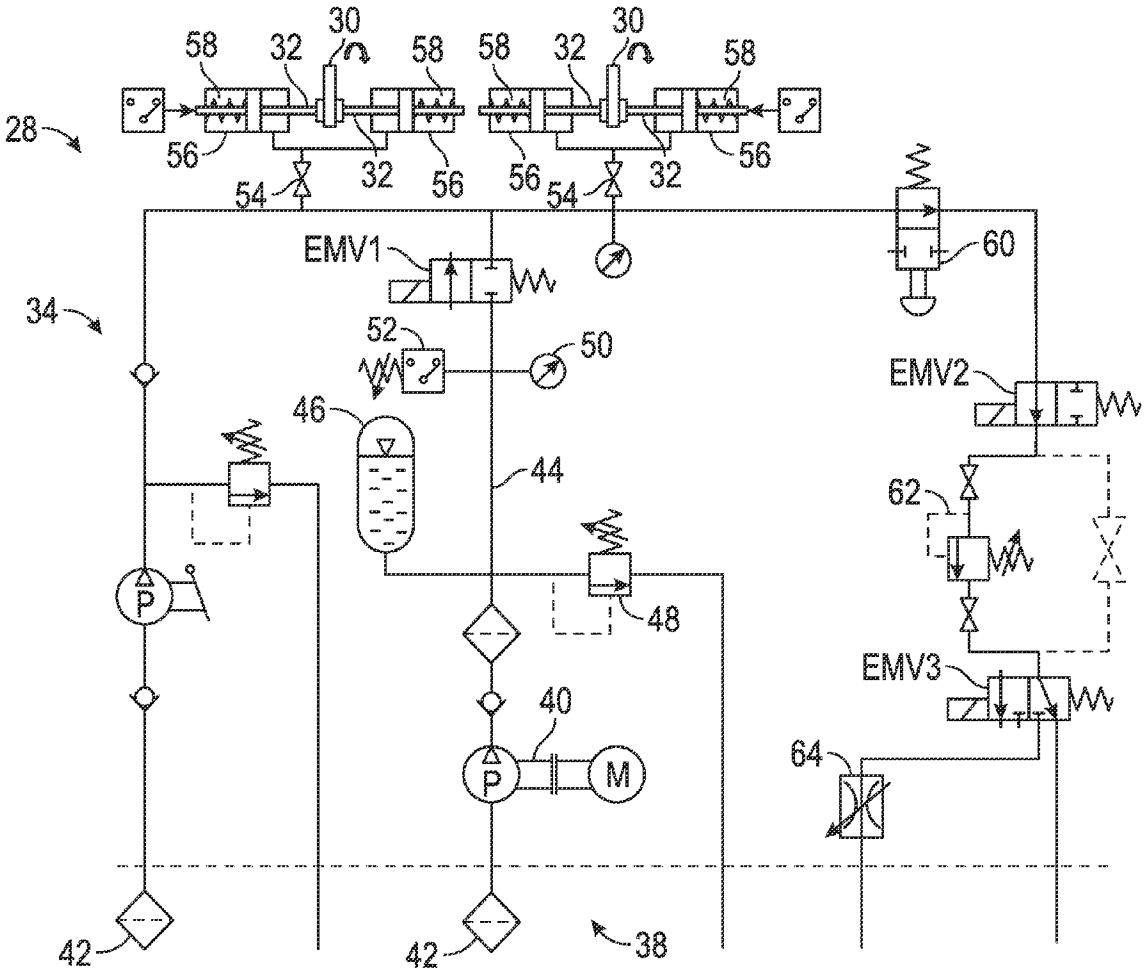
FIG. 3 is a schematic view of an embodiment of a hydraulic brake unit of an elevator system.

Referring to FIG. 3, shown is a schematic of the brake unit 28, including two of calipers 32 operably connected to the hydraulic power unit 34. The hydraulic power unit 34 includes a volume of hydraulic fluid in a fluid sump 38, which is flowed through the hydraulic power unit 34 to actuate the calipers 32. The hydraulic power unit 34 includes a motor driven pump 40 to urge fluid from the sump 38, and may include one or more filters 42 to remove contaminants from the fluid flow along a fluid input line 44. An accumulator 46 and a pressure relief valve 48 may be located along the fluid input line 44 to regulate fluid pressure thereat based on feedback from an input pressure gauge 50 and input pressure switch 52. A first electromagnetic valve, EMV1, is located along the fluid input line 44 and controls fluid flow from the fluid input line 44 to the remainder of the hydraulic power unit 34, biasing the calipers 32 to an engaged position by, for example, springs 58 or other biasing means.

The hydraulic power unit 34 further includes a push valve 60, a second electromagnetic valve, EMV2, a pressure limiting valve 62, a third electromagnetic valve, EMV3, and a flow control valve 64, as will be described in more detail below.

Figure 4:
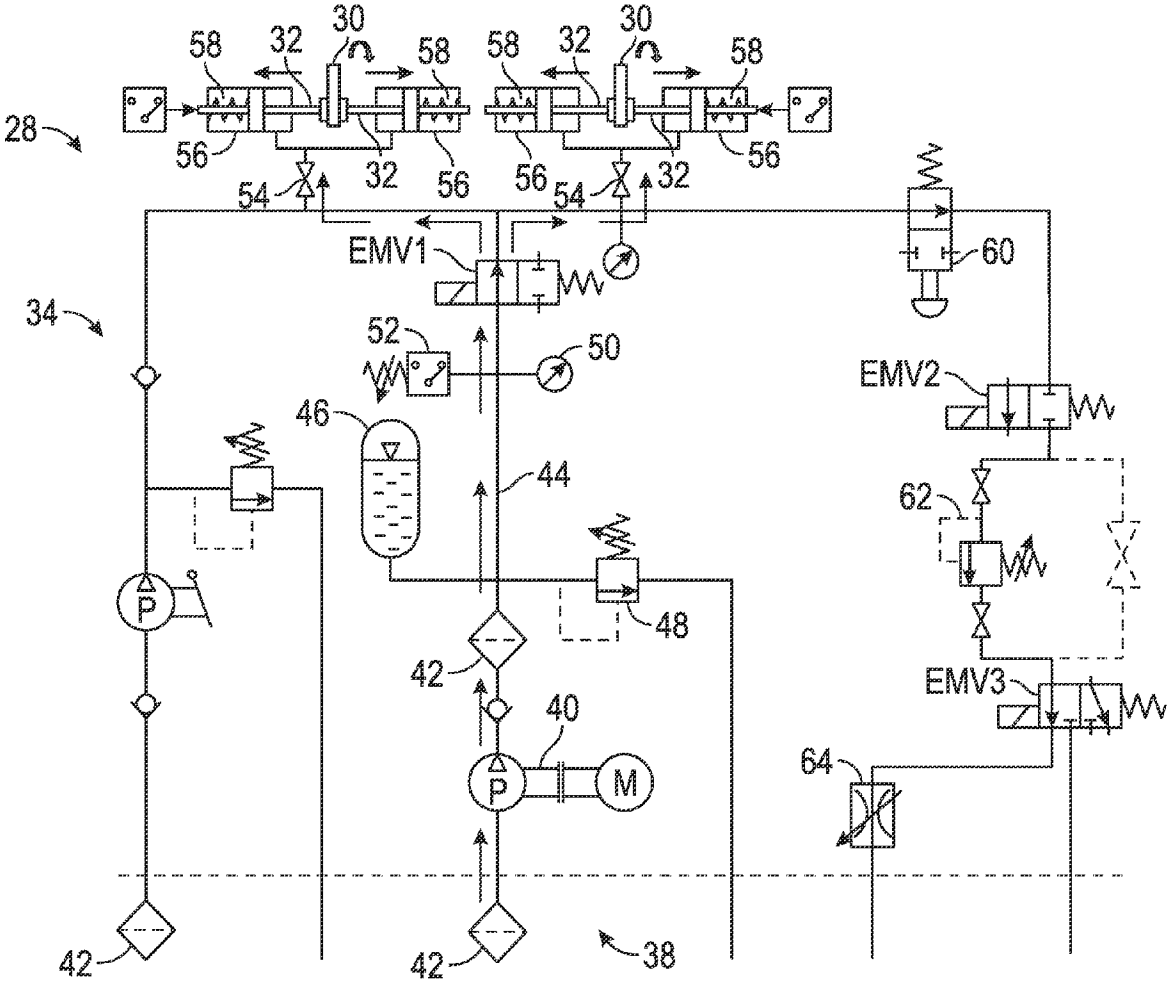
FIG. 4 is a schematic view of an embodiment of a hydraulic brake unit of an elevator system in running mode.

Referring now to FIG. 4, the brake unit 28 is illustrated as configured during running mode, or normal operation of the elevator system 10, when the elevator car 12 is in motion in the hoistway 14. In running mode, the brake unit 28 is energized and the motor pump 40 urges hydraulic fluid from the sump 38 along the fluid input line 44. EMV1 is open allowing fluid therethrough to the caliper cylinders 56. EMV2 and EMV3 are closed allowing fluid pressure to build up in the caliper cylinders 56 to overcome the bias of the springs 58 in the caliper cylinders 56 and urging the calipers 43 away from the brake disc 30. Moving the calipers 32 away from the brake disc 30 releases the brake allowing for movement of the elevator car 12.

Figure 5:
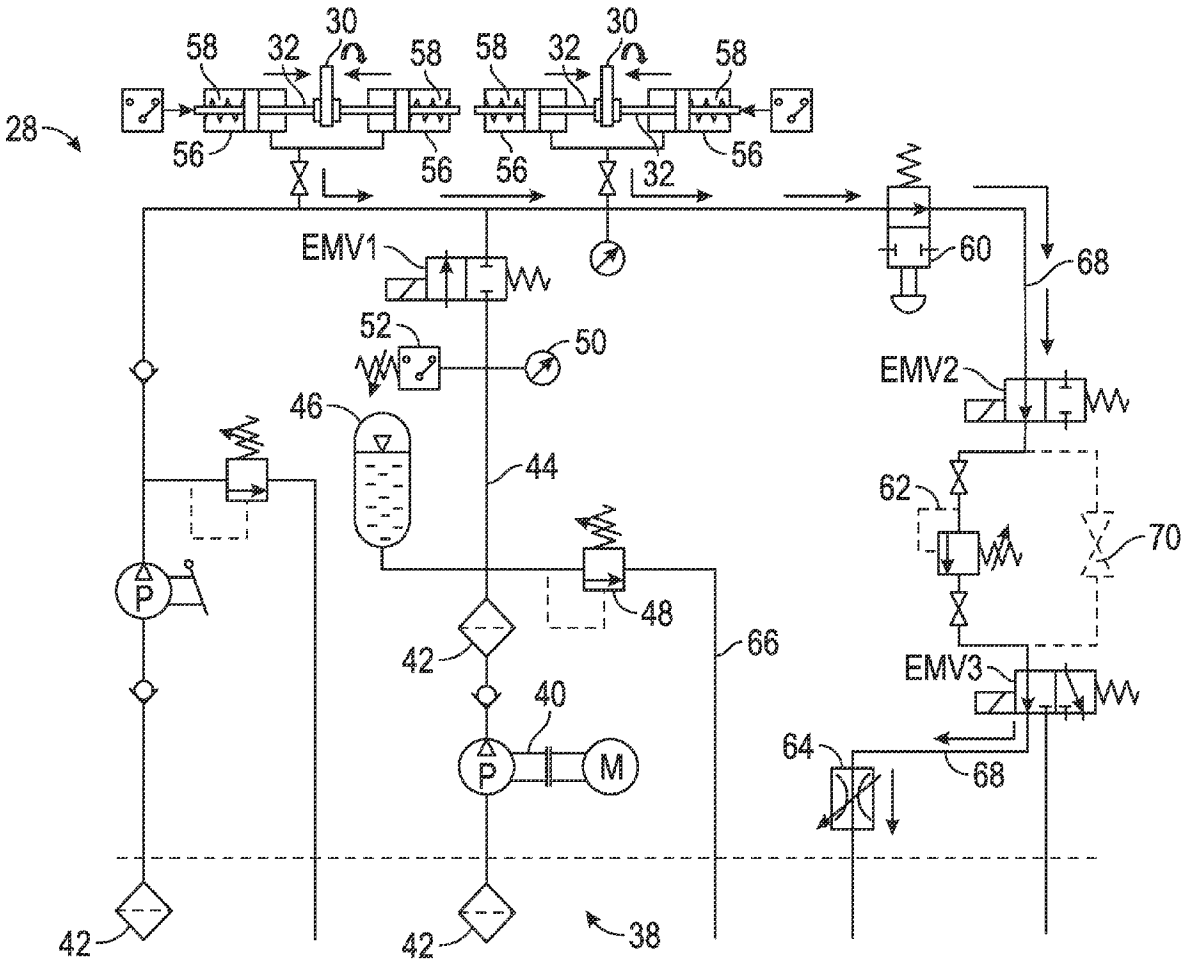
FIG. 5 is a schematic view of an embodiment of a hydraulic brake unit of an elevator system in holding mode.

Referring to FIG. 5, the brake unit 28 is illustrated as configured when in holding mode, when the brake unit 28 is utilized to stop and hold the elevator car 12 at a floor. In holding mode, EMV2 is deenergized and shifted into open position allowing fluid flow therethrough and EMV3 is positioned to allow fluid flow therethrough and through the flow control valve 64. Further, EMV1 is closed and fluid remains in line 44. With EMV1 closed and EMV2 open, the fluid in caliper cylinders 56 flows from the caliper cylinders and through output line 68 via EMV2 and pressure limiting valve 62. Thus springs 58 force calipers 32 into engagement with the brake disc 30. Hydraulic fluid flows through EMV3 and flow control valve 64 and returns to the sump 38. Field adjustability of the brake unit 28 is achieved via the pressure limiting valve 62, which allows brake release pressure adjustability and brake torque adjustability. If full braking torque is required by the elevator system 10, pressure limiting valve 62 is disabled and shut off valve 70 is opened. Brake caliper 32 impact noise is reduced by flow control valve 64 which reduces fluid flow rate from the caliper cylinders 56 and thus reduce a rate of impact of the calipers 32 to the brake disc 30.

Figure 6:
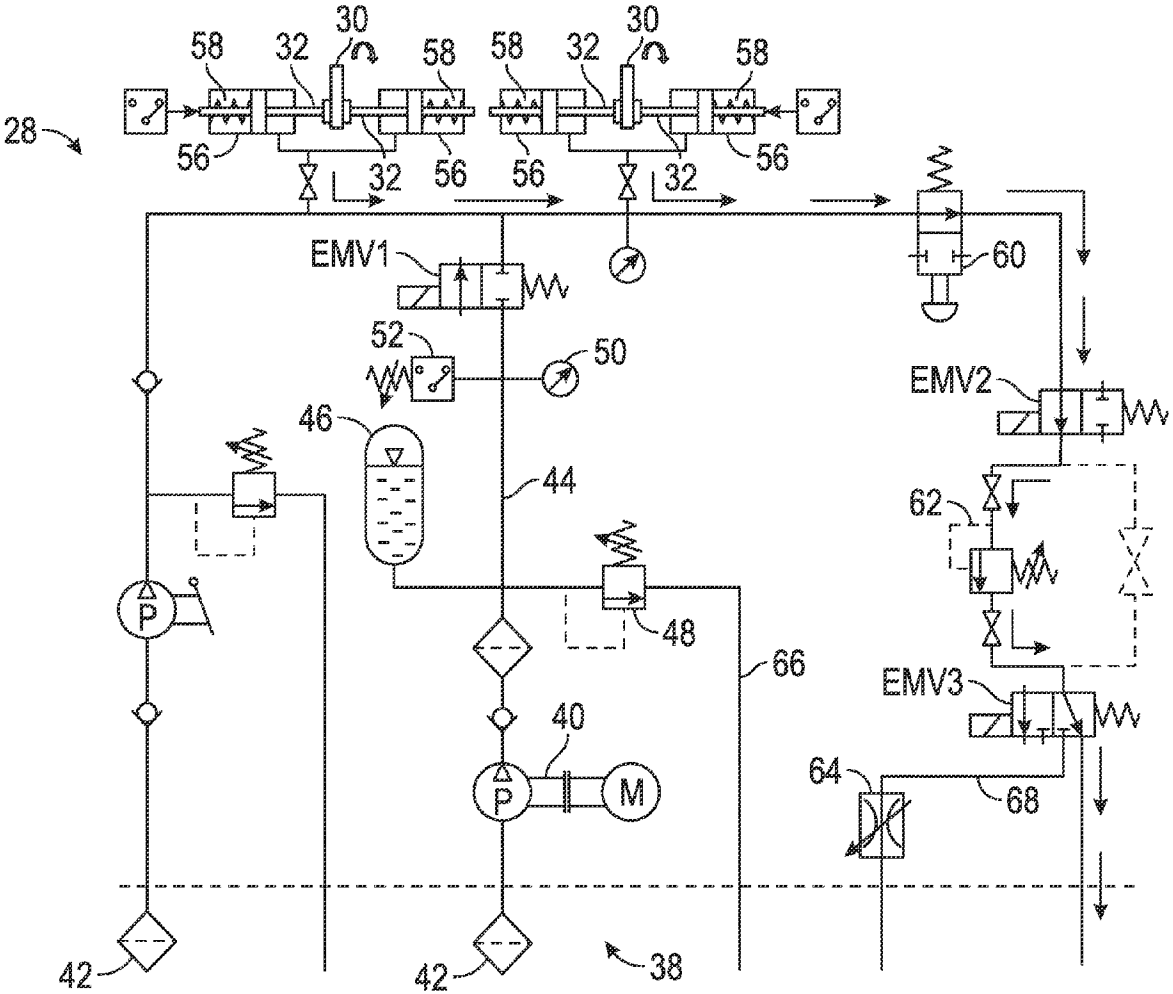
FIG. 6 is a schematic view of an embodiment of a hydraulic brake unit of an elevator system in shut down mode.

Referring now to FIG. 6, the brake unit 28 is shown as configured when in shut down mode or emergency mode. In this mode, power is shut off to the brake unit 28, and EMV1 is closed preventing flow from the input line 44 from reaching the caliper cylinders 56. EMV2 and EMV3 are opened allowing flow therethrough, bypassing the flow control valve 64 and returning fluid directly to the sump 38 from the caliper cylinders 56 engaging the calipers 32 to the brake disc 30. In this mode, the elevator car 12 is held at its present location.

Figure 7:
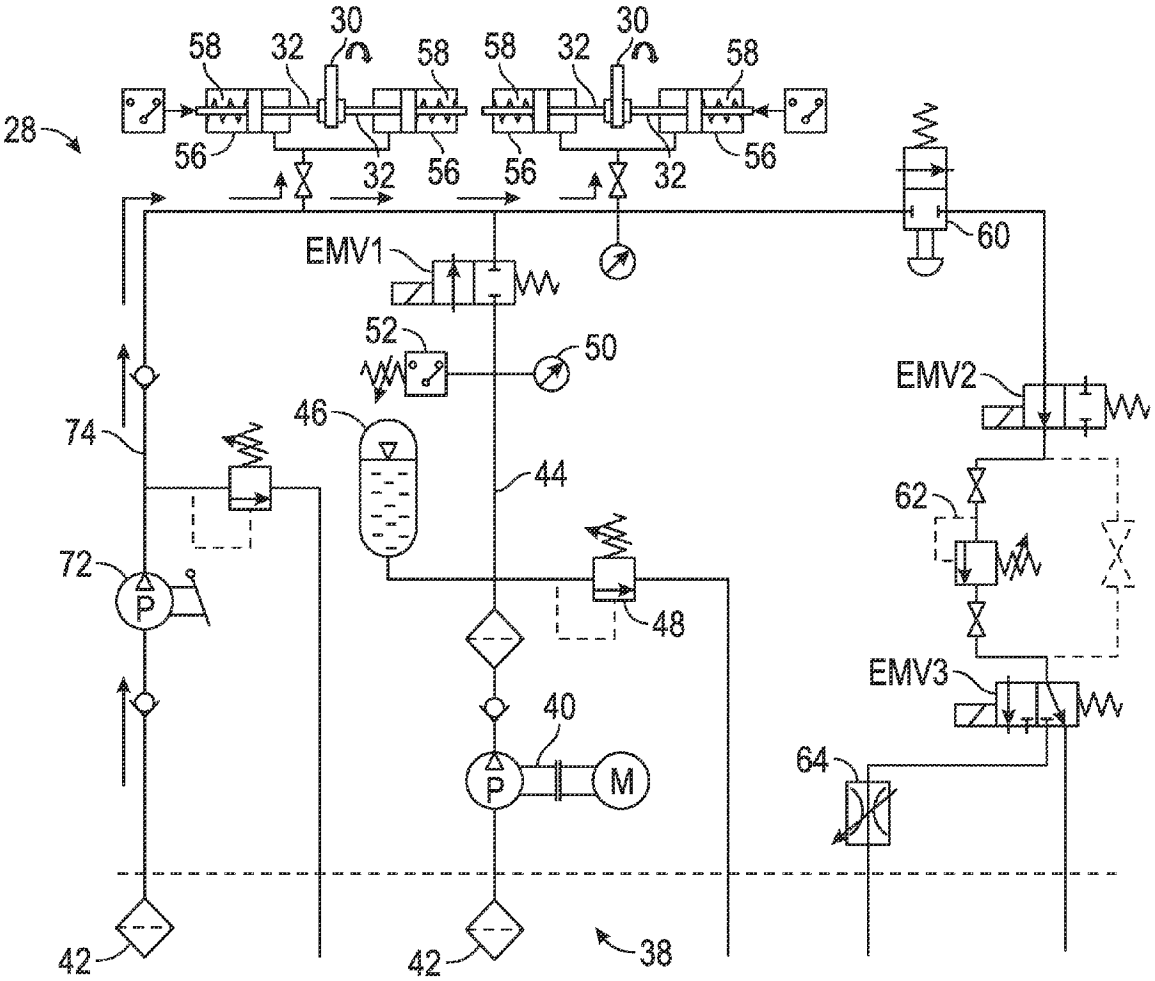
FIG. 7 is a schematic view of an embodiment of a hydraulic brake unit of an elevator system in rescue mode.

Referring now to FIG. 7, illustrated is the brake unit 28 configured for rescue mode, utilized to move the elevator car 12 to a selected floor when the brake unit 28 is unpowered. In this mode, EMV1 is closed and EMV2 and EMV3 are open. Push valve 60 is closed by hand and hand pump 72 is operated to urge fluid from the sump 38 through alternate input line 74 and into caliper cylinders 56. With push valve 60 closed, the caliper cylinders 56 are pressurized and calipers 32 overcome spring 58 bias and are released from engagement with the brake disc 30. The elevator car 12 is then moved to a selected floor or location. When the selected location is reached, push valve 60 is deactivated and opened, allowing fluid pressure to be releases from the caliper cylinders 56, engaging the calipers 32 with the brake disc 30 stopping the elevator car 12.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A braking system for an elevator comprising:
a brake disc;
one or more brake calipers interactive with the brake disc; and
a hydraulic brake unit operably connected to the one or more brake calipers, the hydraulic brake unit including a plurality of valves to control hydraulic fluid flow during engagement of the brake calipers to the brake disc, the plurality of valves including:
a first electromagnetic valve positioned and configured to control hydraulic fluid flow from a hydraulic fluid source to the one or more brake calipers;
a second electromagnetic valve positioned and configured to control hydraulic fluid flow from the one or more brake calipers; and
a third electromagnetic valve is positioned to direct hydraulic fluid flow from the one or more brake calipers to a hydraulic fluid source;
wherein the third electromagnetic valve directs hydraulic fluid flow to a flow control valve to reduce a hydraulic fluid flow rate in the brake unit, thereby reducing brake caliper to brake disc impact force and noise.

2. The braking system of claim 1, wherein the plurality of valves further includes a pressure limiting valve to maintain hydraulic fluid pressure in the brake unit within a selected range, thereby limiting braking torque of the braking system.

3. The braking system of claim 1, further comprising a hand-operated pump to pressurize the hydraulic brake unit in the case of a power outage.

4. The braking system of claim 3, further comprising a hand-operated push valve to relieve hydraulic pressure in the hydraulic brake unit.

5. The braking system of claim 1, where the one or more brake calipers is two brake calipers.

6. The braking system of claim 1, wherein the third electromagnetic valve directs hydraulic flow directly to the hydraulic fluid source.

7. An elevator system comprising:
an elevator car;
one or more sheaves;
a suspension member connected to the elevator car and routed around the one or more sheaves to support the elevator car;
a machine to drive motion of the elevator car via the suspension member; and
a braking system disposed at the machine to stop and hold the elevator car, the braking system including:
a brake disc;
one or more brake calipers interactive with the brake disc; and
a hydraulic brake unit operably connected to the one or more brake calipers, the hydraulic brake unit including a plurality of valves to control hydraulic fluid flow during engagement of the brake calipers to the brake disc, the plurality of valves including:
a first electromagnetic valve positioned and configured to control hydraulic fluid flow from a hydraulic fluid source to the one or more brake calipers;
a second electromagnetic valve positioned and configured to control hydraulic fluid flow from the one or more brake calipers; and
a third electromagnetic valve is positioned to direct hydraulic fluid flow from the one or more brake calipers to a hydraulic fluid source;
wherein the third electromagnetic valve directs hydraulic fluid flow to a flow control valve to reduce a hydraulic fluid flow rate in the brake unit, thereby reducing brake caliper to brake disc impact force and noise.

8. The elevator system of claim 7, wherein the plurality of valves further includes a pressure limiting valve to maintain hydraulic fluid pressure in the brake unit within a selected range, thereby limiting braking torque of the braking system.

9. The elevator system of claim 7, further comprising a hand-operated pump to pressurize the hydraulic brake unit in the case of a power outage.

10. The elevator system of claim 9, further comprising a hand-operated push valve to relieve hydraulic pressure in the hydraulic brake unit.

11. The elevator system of claim 7, wherein the one or more brake calipers is two brake calipers.

12. The elevator system of claim 7, wherein the third electromagnetic valve directs hydraulic flow directly to the hydraulic fluid source.

* * * * *